US008317042B2

(12) United States Patent
Cerveny

(10) Patent No.: US 8,317,042 B2
(45) Date of Patent: Nov. 27, 2012

(54) LIGHTWEIGHT CONTAINER

(75) Inventor: Jean-Paul Cerveny, Vittel (FR)

(73) Assignee: Nestlé Waters Management and Technology, Issy les Moulineaux (FR)

( * ) Notice: Subject to any disclaimer, the term of this patent is extended or adjusted under 35 U.S.C. 154(b) by 470 days.

(21) Appl. No.: 12/524,760

(22) PCT Filed: Jan. 30, 2008

(86) PCT No.: PCT/EP2008/051115

§ 371 (c)(1),
(2), (4) Date: Jul. 28, 2009

(87) PCT Pub. No.: WO2008/095842

PCT Pub. Date: Aug. 14, 2008

(65) Prior Publication Data

US 2010/0116771 A1 May 13, 2010

(30) Foreign Application Priority Data

Feb. 7, 2007 (EP) ..... 07101873

(51) Int. Cl.
*B65D 7/28* (2006.01)

(52) U.S. Cl. ..... 215/44; 215/252; 215/258; 215/321; 215/324; 215/329

(58) Field of Classification Search ..... 215/44, 215/252, 329, 258, 321, 324
See application file for complete search history.

(56) References Cited

U.S. PATENT DOCUMENTS

| | | | | |
|---|---|---|---|---|
| 5,632,397 | A * | 5/1997 | Fandeux et al. | 215/382 |
| 5,947,311 | A * | 9/1999 | Gregory | 215/341 |
| 6,626,324 | B1 | 9/2003 | Boyd | 220/609 |
| 2002/0134747 | A1 | 9/2002 | Babcock et al. | 215/252 |
| 2005/0048235 | A1 | 3/2005 | Dygert | 428/35.7 |
| 2006/0175281 | A1 * | 8/2006 | Ekkert | 215/252 |
| 2007/0051688 | A1 | 3/2007 | Dygert et al. | 215/44 |

FOREIGN PATENT DOCUMENTS

| | | |
|---|---|---|
| CN | 1232768 | 10/1999 |
| WO | WO 02/02417 | 1/2002 |

OTHER PUBLICATIONS

International Search Report, PCT/EP2008/051115, dated Apr. 1, 2008.

* cited by examiner

*Primary Examiner* — Anthony Stashick
*Assistant Examiner* — Elizabeth Volz
(74) *Attorney, Agent, or Firm* — Winston & Strawn LLP

(57) ABSTRACT

The present invention concerns a package that includes (i) a container with a body and a neck, a container opening with an opening diameter (d), a screw thread, and a flange extending outwardly and having a flange diameter (D), and (ii) a removable closure adapted to be unscrewed from the screw threads of the container, with the closure having a top, a skirt and a tamper-evident ring attached to the lower edge of the skirt and is adapted to catch the flange of the container's neck when the closure is first screwed onto the neck. The ring is detachable from the skirt upon first removal of the closure from the neck. The container has a top load resistance inferior or equal to 30 daN, and the height h between the neck top edge and the lower part of the flange is such that it satisfies the relationship $h \leqq (d/3)$.

22 Claims, 1 Drawing Sheet

LIGHTWEIGHT CONTAINER

This application is a 371 filing of International Patent Application PCT/EP2008/051115 filed Jan. 30, 2008.

BACKGROUND

The present invention concerns a lightweight package comprising a container and a closure for removably closing said container, said closure having tamper-evident means.

The packages that are typically used for storing and dispensing liquids such as mineral water comprise a container with a container body and a container neck, and a closure for said container.

In the following description, and as a matter of non-limiting example, the container will be described as a bottle, intended for containing mineral water. Due to safety issues, the closure comprises a tamper-evident ring that is secured to a tamper evident flange of the bottle neck, and is detached from the rest of the closure when the latter is first removed from the bottle.

Further, the bottles are generally made from an injected preform that is heated and blown in a mould to produce the bottle that will then be filled, closed and labelled. In order to carry the preform and then blown bottle along the manufacturing, filling and closing lines of a facility, a second flange is disposed on the neck of the preform/bottle, which is located at a lower level than the tamper-evident flange.

This transportation flange is also very important to ensure a good stabilization of the bottle during the screwing or snapping/screwing operation (i.e. closing operation). In recent years, the thickness of the bottle walls has decreased to save packaging material used to make them, which results in less top load resistance of the bottles. In such conditions, when the closure is pressed and screwed on lines to close the bottle, the pressure is such that the sole bottle walls could not stand this pressure. Therefore, the screwing machines include a system that holds the neck of the bottle below the transportation flange, so that the vertical—top-down—pressure applied onto the bottle during screwing, does not deform or damage the bottle walls.

In the recent times, a trend appeared to reduce the amount of packaging material used for manufacturing containers and closures, due to increasing prices of the ground materials, as well as environmental issues.

Such an effort to reduce the amount of plastics material used resulted in injection-blown new packages being marketed, wherein the tamper-evident and transportation flanges are combined.

However, there still exist a need to provide a package of the type described above which comprises even less thermoplastic material, while allowing an injection-blowing manufacturing process.

SUMMARY OF THE INVENTION

The present invention meets the above described needs with a package comprising:

(i) a container made out of an injected preform that is blown, with a container body and a container neck comprising a container opening with an opening diameter d, a screw thread, and a flange extending outwardly and having a flange external diameter D, and (ii) a closure adapted to be removably screwed onto the screw thread of said container neck in order to close said container opening, said closure comprising a closure top, a closure skirt and a tamper-evident ring that is attached to the lower edge of the skirt and is adapted to catch the flange of the container's neck when said closure is first screwed onto the neck, said tamper-evident ring being detachable from the skirt upon first removal of the closure from said neck, said container having a top load resistance inferior or equal to 30 daN, characterized in that: the height h between the neck top edge and the lower part of the neck flange is such that: $h \leqq (d/3)$.

According to this ratio, the neck height which is obtained is very low, while still allowing to form at least one screw thread around the portion of the neck which is located above the flange. Necessarily, the height of the corresponding closure is very small, which allows very important savings on the plastics material that is used for the bottle neck and closure, while still keeping good liquid-proof properties and tamper-evident features.

The top load resistance of the package is measured according to the following method: standardized test method for top load measurement according to ASTM D 2659-89 standard, equivalent to DIN 55440-1:99 standard. Typically, it is considered that the limit of resistance of the bottle is achieved when it flexes more than 3 mm vertically or if it collapses upon application of a vertical pressure applied downwardly from the top, the bottle being emptied, dry, and unclosed. Test is usually performed at room temperature (around 23° C.).

Preferably, the flange of the neck is adapted to receive carrying means for transportation of the preform or corresponding container (once the preform has been blown into a container) on the manufacturing lines.

Preferably, the container body has a generally ovoid or round cross-section. However, any other shape could be valid as well, eg. a generally square cross section.

Furthermore, in a highly preferred embodiment of the present invention, the external diameter D of the flange is such that: $(1.3 \times d) \leqq D \leqq (1.5 \times d)$.

Even more preferably, the external diameter D of the flange is such that: $D = 1.4 \times d$.

Advantageously, the container can be made of a thermoplastics material selected from the list of: polyethyleneterephtalate (PET), polyethylenenaphtalate (PEN), polyethyleneterephtalateglycol (PETG), high density polyethylene (PEHD), polypropylene, polycarbonate, or a mixture thereof.

Also preferably, the opening diameter d is less than 55 mm, more preferably less than 35 mm, even more preferably less than 25 mm.

The closure is preferably manufactured by injection or compression process of a thermoplastics material such as polyethylene.

BRIEF DESCRIPTION OF THE DRAWINGS

Additional features and advantages of the present invention are described in, and will be apparent from, the description of the presently preferred embodiment which is set out below with reference to the drawings in which.

DETAILED DESCRIPTION OF THE INVENTION

Figure 1:
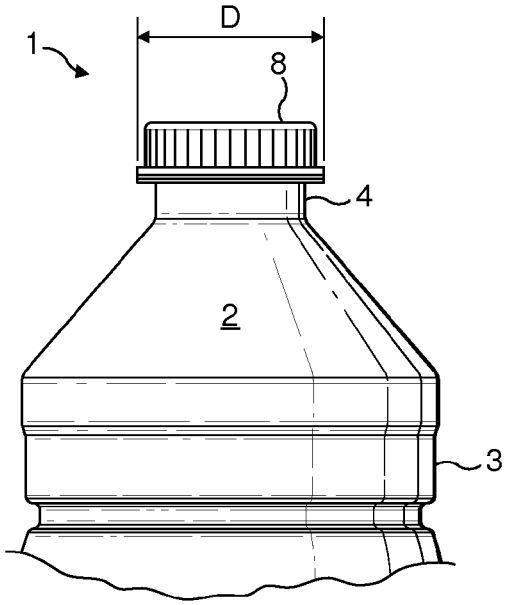
FIG. 1 is a partial schematic view of a package according to the present invention.
Figure 2:
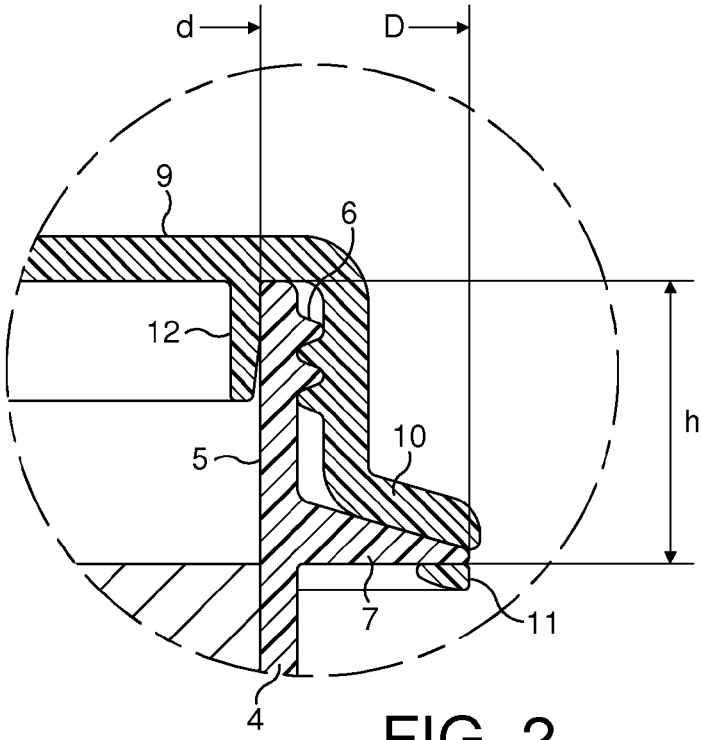
FIG. 2 is a partial schematic enlarged profile cut view showing the neck and closure in a package according to the invention.

As shown in FIGS. 1 and 2, the present invention concerns a package 1 for storing and dispensing food-grade liquids such as mineral water.

The package 1 according to the present invention comprises, firstly, a container 2 made out of an injected preform (not shown in the drawing) that is blown in a mould after being heated.

The container 2 has a container body 3 with a generally round section, and a container neck 4. The neck 4 defines at its upper part a container opening 5 with an opening diameter d. The neck 4 further comprises a screw thread 6, and a flange 7 extending outwardly and having a flange external diameter D.

The package 1 comprises, secondly, a closure 8 adapted to be removably screwed onto the screw thread 6 of the container neck 4.

The said closure 8 comprises a closure top 9, a closure skirt 10 and a tamper-evident ring 11 that is attached to the lower edge of the skirt 10 and is adapted to catch the flange 7 of the container's neck 4 when said closure 8 is first screwed or snapped onto the neck 4, said tamper-evident ring 11 being detachable from the skirt 10 upon first removal of the closure 8 from said neck 4.

Finally, the closure 8 comprises a liquid-tight circular lip 12 extending downwards from the interior surface of the closure top wall 9, said lip 12 being such as to sealingly contact the internal surface of the neck 4 when the closure is screwed onto said neck, as shown in FIG. 2.

Alternatively, the lip 12 could be replaced by a disc-shaped seal made of a foamed plastic material, or any other material suitable for sealing, for example an aluminium foil, and disposed as a double top wall adjacent the interior surface of the closure top wall (not shown in the drawing).

The container has a top load resistance inferior or equal to 20 daN, as measured by the ASTM D 2659-89 and DIN 55440-1:99 standards.

Importantly, according to the present invention, the height h between the top edge of the neck 4 and the lower part of the neck flange 7 is such that: $h \leqq (d/3)$.

Furthermore, the flange 7 of the neck 4 has an external diameter D of the flange is such that: $(1.3 \times d) \leqq D \leqq (1.5 \times d)$, and is therefore adapted to receive carrying means for transportation of the container on the manufacturing lines. Such carrying means can be for instance a pair of ring halves that are closed around the neck during transportation and form an annular support in contact with the lower surface of the flange 7 during transportation and screwing operations. Other types of carrying means may be used as well.

In the embodiment of the present invention shown in FIGS. 1 and 2, the container 2 is made of polyethylenetherephtalate (PET), and the closure 8 is manufactured by a compression process of a thermoplastics material such as polyethylene.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

For instance, the closure, while being adapted to be screwed and unscrewed from the screw threads of the container neck, can also be snapped onto the container neck when the container is first closed after filling. In subsequent closing operations, the consumer will have the choice to snap or screw the said closure onto the screw threads of the neck.

What is claimed is:

1. A package comprising:

(i) a container made out of an injected preform that is blown, with a container body and a container neck comprising a container opening with an opening diameter d, a screw thread, and a flange extending outwardly and having a flange external diameter D, and (ii) a closure adapted to be removably screwed onto the screw thread of the container neck in order to close the container opening, the closure comprising a closure top, a closure skirt and a tamper-evident ring that is attached to the lower edge of the skirt and is configured and dimensioned to pass over the flange of the container's neck and catch the bottom portion thereof when the closure is first screwed onto the neck, the tamper-evident ring being detachable from the skirt upon first removal of the closure from the neck, the container having a top load resistance inferior or equal to 30 daN, wherein the height h between the neck top edge and the lower part of the neck flange is such that it satisfies the relationship $h<(d/3)$.

2. The package according to claim 1, wherein the flange of the neck is adapted to receive carrying means for transportation of the preform or corresponding container on the manufacturing lines.

3. The package according to claim 1, wherein the container is made of a thermoplastic material selected from the group consisting of polyethylenetherephtalate (PET), polyethylenenaphtalate (PEN), polyethylenetherephtalateglycol (PETG), high density polyethylene (PEHD), polypropylene, polycarbonate, and mixtures thereof.

4. The package according to claim 1, wherein the closure is made by injection or compression process.

5. The package according to claim 1, wherein the container body has a generally ovoid or round cross-section.

6. The package according to claim 1, wherein the container has a top load resistance inferior or equal to 20 daN.

7. The package according to claim 1, wherein the external diameter D of the flange is such that it satisfies the relationship $(1.3 \times d) \leqq D > (1.5 \times d)$.

8. The package according to claim 7, wherein the external diameter D of the flange is such that it satisfies the relationship $D=1.4 \times d$.

9. The package according to claim 1, wherein the opening diameter d is less than 55 mm.

10. The package according to claim 9, wherein the opening diameter d is less than 35 mm.

11. The package according to claim 1, wherein the closure skirt has a first portion that is provided with threads on an interior surface for engaging the screw thread of the container, and a second portion that forms the lower edge of the skirt and that includes the tamper-evident ring, wherein the second portion includes an extension that is arranged at an angle to the first portion and that extends away from the container neck, with the second portion contacting the bottom portion of the flange of the container neck for a seal therewith when the closure is screwed onto the neck.

12. The package according to claim 11, wherein the tamper-evident ring is configured to extend from the lower edge of the second portion of the closure skirt and engage the periphery of the lower portion of the flange of the container neck.

13. A package comprising:

(i) a container made of thermoplastic material and having a container body and a container neck that includes a container opening with an opening diameter d, a screw thread, and a flange extending outwardly from the neck and having a flange external diameter D, and (ii) a closure adapted to be removably screwed onto the screw thread of the container neck in order to close the container opening, the closure including a closure top, a closure skirt and a tamper-evident ring that is attached to the lower edge of the skirt and that is adapted to catch the flange of the container neck when the closure is first screwed onto the neck, with the tamper-evident ring being detachable from the skirt upon first removal of the closure from the neck, and with the container having a top load resistance less than or equal to 30 daN, wherein the height h between the neck top edge and the lower part of the neck flange is such that it satisfies the relationship $h<(d/3)$ and wherein the external diameter D of the flange is such that it satisfies the relationship $(1.3\times d)\leqq D\leqq(1.5\times d)$ to facilitate transportation of the package on manufacturing lines.

14. The package according to claim 13, wherein the thermoplastic material is selected from the group consisting of polyethylenetherephtalate (PET), polyethylenenaphtalate (PEN), polyethylenetherephtalateglycol (PETG), high density polyethylene (PEHD), polypropylene, polycarbonate, and mixtures thereof.

15. The package according to claim 13, wherein the closure skirt has a first portion that is provided with threads on an interior surface for engaging the screw thread of the container, and a second portion that forms the lower edge of the skirt and that includes the tamper-evident ring, wherein the second portion includes an extension that is arranged at an angle to the first portion and that extends away from the container neck, with the second portion contacting the flange of the container neck for a seal therewith when the closure is screwed onto the neck.

16. The package according to claim 15, wherein the tamper-evident ring is configured to extend from the lower edge of the second portion of the closure skirt and engage the periphery of the flange of the container neck.

17. A package comprising:

(i) a container made of thermoplastic material and having a container body and a container neck that includes a container opening with an opening diameter d, a screw thread, and a flange extending outwardly from the neck and having a flange external diameter D, and (ii) a closure adapted to be removably screwed onto the screw thread of the container neck in order to close the container opening, the closure including a closure top, a closure skirt, a tamper-evident ring that is attached to the lower edge of the skirt and that is adapted to catch the flange of the container neck when the closure is first screwed onto the neck, with the tamper-evident ring being detachable from the skirt upon first removal of the closure from the neck, and a circular lip extending into the container opening to sealing contact the interior surface of the container opening, wherein the container has a top load resistance less than or equal to 30 daN, the height h between the neck top edge and the lower part of the neck flange is such that it satisfies the relationship $h<(d/3)$ and the external diameter D of the flange is such that it satisfies the relationship $(1.3\times d)\leqq D\leqq(1.5\times d)$ to facilitate transportation of the package on manufacturing lines.

18. The package according to claim 17, wherein the thermoplastic material is selected from the group consisting of polyethylenetherephtalate (PET), polyethylenenaphtalate (PEN), polyethylenetherephtalateglycol (PETG), high density polyethylene (PEHD), polypropylene, polycarbonate, and mixtures thereof.

19. The package according to claim 18, wherein the closure skirt has a first portion that is provided with threads on an interior surface for engaging the screw thread of the container, and a second portion that forms the lower edge of the skirt and that includes the tamper-evident ring, wherein the second portion includes an extension that is arranged at an angle to the first portion and that extends away from the container neck, with the second portion contacting the flange of the container neck for a seal therewith when the closure is screwed onto the neck.

20. The package according to claim 19, wherein the tamper-evident ring is configured to extend from the lower edge of the second portion of the closure skirt and engage the periphery of the flange of the container neck.

21. A package comprising:

(i) a container made out of an injected preform that is blown, with a container body and a container neck comprising a container opening with an opening diameter d, a screw thread, and a flange extending outwardly and having a flange external diameter D, and (ii) a closure adapted to be removably screwed onto the screw thread of the container neck in order to close the container opening, the closure comprising a closure top, a closure skirt and a tamper-evident ring that is attached to the lower edge of the skirt and is adapted to catch the flange of the container's neck when the closure is first screwed onto the neck, the tamper-evident ring being detachable from the skirt upon first removal of the closure from the neck, the container having a top load resistance inferior or equal to 30 daN, wherein the height h between the neck top edge and the lower part of the neck flange is such that it satisfies the relationship $h<(d/3)$ and wherein the external diameter D of the flange is such that it satisfies the relationship $(1.3\times d)\leqq D\leqq(1.5\times d)$.

22. The package according to claim 21, wherein the external diameter D of the flange is such that it satisfies the relationship $D=1.4\times d$.

* * * * *

UNITED STATES PATENT AND TRADEMARK OFFICE

CERTIFICATE OF CORRECTION

PATENT NO. : 8,317,042 B2
APPLICATION NO. : 12/524760
DATED : November 27, 2012
INVENTOR(S) : Cerveny It is certified that error appears in the above-identified patent and that said Letters Patent is hereby corrected as shown below:

Title Page:

Item (57) ABSTRACT, last line, change "h≦(d/3)" to -- h≤(d/3) --.

Column 2:

Line 8, change "h≦(d/3)" to -- h≤(d/3) --.

Line 36, change "(1.3×d)≦D≦(1.5×d)" to -- (1.3×d)≤D≤(1.5×d) --.

Column 3:

Line 35, change "h≦(d/3)" to -- h≤(d/3) --.

Line 37, change "(1.3×d)≦D≦(1.5×d)" to -- (1.3×d)≤D≤(1.5×d) --.

Column 4:

Line 35, "(1.3×d)≦D>(1.5×d)" to -- (1.3×d)≤D≤(1.5×d) --.

Column 5:

Line 10, change "(1.3×d)≦" to -- (1.3×d)≤ --.

Line 11, change "D≦(1.5×d)" to -- D≤(1.5×d) --.

Column 6:

Line 4, change "(1.3×d)≦D≦(1.5×d)" to -- (1.3×d)≤D≤(1.5×d) --.

Line 45, change "(1.3×d)≦D≦(1.5×" to -- (1.3×d)≤D≤(1.5× --.

Signed and Sealed this
Twelfth Day of February, 2013

Teresa Stanek Rea
*Acting Director of the United States Patent and Trademark Office*